US009764202B2

(12) United States Patent
Chen

(10) Patent No.: US 9,764,202 B2
(45) Date of Patent: Sep. 19, 2017

(54) BALL COLLECTING DEVICE WITH BALL COLLECTING MODULE

(71) Applicant: FAR EAST UNIVERSITY, Tainan (TW)

(72) Inventor: Yu-Gang Chen, Tainan (TW)

( * ) Notice: Subject to any disclaimer, the term of this patent is extended or adjusted under 35 U.S.C. 154(b) by 0 days.

(21) Appl. No.: 15/387,628

(22) Filed: Dec. 21, 2016

(65) Prior Publication Data

US 2017/0189769 A1 Jul. 6, 2017

(30) Foreign Application Priority Data

Dec. 31, 2015 (TW) ..... 104144807 A
Dec. 9, 2016 (TW) ..... 105218881 U

(51) Int. Cl.
*A63B 47/02* (2006.01)

(52) U.S. Cl.
CPC ..... *A63B 47/021* (2013.01)

(58) Field of Classification Search
CPC ..... A63B 47/02; A63B 47/021; A63B 47/024; A63B 2210/50; A01D 51/002
USPC ..... 294/19.2; 414/439, 440
See application file for complete search history.

(56) References Cited

U.S. PATENT DOCUMENTS 2,817,405 A * 12/1957 Pearson ..... A63D 5/02 171/63
3,593,868 A * 7/1971 Folz ..... A63B 47/021 414/440
3,825,136 A * 7/1974 Rettedal ..... A63B 47/021 414/434
3,856,165 A * 12/1974 Gustafson ..... A63B 47/021 414/440
4,077,533 A * 3/1978 Meyer ..... A63B 47/021 414/440
4,721,428 A * 1/1988 Rohrer ..... A63B 47/021 414/439
4,844,527 A * 7/1989 Ray ..... A63B 47/021 294/19.2
5,152,565 A * 10/1992 Dodd ..... A63B 47/02 294/19.2
8,075,030 B2 * 12/2011 Pearson ..... A63B 47/02 294/179
8,132,836 B2 * 3/2012 Chen ..... A63B 47/02 294/19.2

FOREIGN PATENT DOCUMENTS

KR WO2006001678 A1 1/2006
TW 201534373 A 9/2015
WO WO 2006/072442 * 7/2006

* cited by examiner

*Primary Examiner* — Dean Kramer

(57) ABSTRACT

A ball collecting device with ball collecting module having a collecting component and at least one ball collecting module is disclosed. The collecting component has an accommodation space for accommodating at least one ball such that the ball can be collected into the accommodation space by rotating the collecting component. The ball collecting module is pivoted on the collecting component such that an angle is formed between the ball collecting module and a rotation axle of the collecting component, and the angle is smaller than 90 degrees or equal to 90 degrees. A constant distance between the ball collecting module and a plane is maintained when the ball is collected by the ball collecting device.

18 Claims, 12 Drawing Sheets

BALL COLLECTING DEVICE WITH BALL COLLECTING MODULE

CROSS-REFERENCE TO RELATED APPLICATION

This application claims priorities from Taiwan Patent Application No. 104144807, filed on Dec. 31, 2015, and Taiwan Patent Application No. 105218881, filed on Dec. 9, 2016, in the Taiwan Intellectual Property Office, the entire contents of which are hereby incorporated by reference in their entirety for all purposes.

BACKGROUND OF THE INVENTION

1. Field of the Invention

The present invention relates to a ball collecting device, in particular with respect to a ball collecting device with ball collecting module.

2. Description of the Related Art

With the improvement of people's living standards and attention of health, a variety of ball games, such as golf, tennis, table tennis, baseball and so on, has become one of the modern leisure activities. However, in conventional ball games, it is often needed to pick up balls distributed around the course during training or after the game or practice such that the balls can be collected together into a collection bucket. Therefore, in addition to paying attention on the ball games, athletes need to spend a lot of manpower, time and energy to collect the balls, which will unavoidably affect the training efficiency of the athletes and may even result in muscle soreness and other injuries due to repeatedly picking up the balls.

Currently, there is a technique used for collecting balls by rotating a ball collecting utensil. However, this kind of ball collecting utensil can only collect the balls in the specific area because of its size limitation. The user must scroll the ball collecting utensil backward and forward repeatedly to collect all of the balls, resulting in time and energy wasting.

SUMMARY OF THE INVENTION

In view of the aforementioned technical problems of the prior art, one purpose of the present invention is to provide a ball collecting device with ball collecting module so as to solve the problem of inefficiently collecting balls because of size limitation of the ball collecting utensil in prior art.

In order to accomplish the preceding purpose, the present invention provides a ball collecting device with ball collecting module, which comprises: a collecting component and at least one ball collecting module. The collecting component has an accommodation space being used for accommodating at least one ball such that the ball can be collected into the accommodation space by rotating the collecting component backward and forward. The ball collecting module is pivoted on the collecting component such that an angle is formed between the ball collecting module and a rotation axle of the collecting component, and the angle is smaller than 90 degrees or equal to 90 degrees. A constant distance between the ball collecting module and a plane is maintained when the ball is collected by the ball collecting device.

The collecting component comprises: at least one rod; a first cover and a second cover disposed on two opposite ends of the rod respectively; and at least one ring-shaped body disposed on the rod with a predetermined interval apart between the first cover and the second cover to form the accommodation space together.

The ball collecting device of the present invention further comprises a support connection module comprising: at least one connection unit disposed on one side of the collecting component; and at least one support module, wherein one end of the support module is connected to the connection unit, and another end of the support module is configured to optionally lean against the plane. Besides, the ball collecting device of the present invention further comprises a control module connected to the connection unit.

The amount of the ball collecting module is two, and the ball collecting modules are pivoted on opposite sides of the collecting component respectively.

The ball collecting module comprises: at least one first ball collecting unit detachably pivoted on the support module; and at least one second ball collecting unit pivoted on the first ball collecting unit. Wherein, the first ball collecting unit is substantially perpendicular to the rotation axle of the collecting component, and the angle is formed between the second ball collecting unit and the rotation axle.

The first ball collecting unit is pivoted on the support module by a first bearing, and the second ball collecting unit is pivoted on the first ball collecting unit by a second bearing.

The ball collecting device of the present invention further comprises a plurality of rollers disposed on two opposite ends of the second ball collecting unit respectively.

The first cover, the second cover and/or the ring-shaped body further comprise(s) at least one hollow part, and a diameter of the hollow part is adjusted according to a diameter of the ball to control the passing of the ball through the hollow part.

A plurality of elastic elements are disposed around the peripheries of one side of the first cover, one side of the second cover and two sides of the ring-shaped body respectively, and the elastic elements are extended in a direction parallel to the rotation axle.

The constant distance between the ball collecting module and the plane is automatically maintained when the ball is collected by the ball collecting device.

The constant distance is identical to a radius of the rollers when the ball is collected by the ball collecting device.

The constant distance between the ball collecting module and the plane is maintained if an angle between the control module and the plane is changed.

The constant distance between the second ball collecting unit and the plane is automatically maintained by a spring or a weight of the second ball collecting unit.

The second ball collecting unit is at a height from the plane, and the height is smaller than or equal to a diameter of the ball.

The second ball collecting unit is a stepped or stepless stretchable structure to steppedly or steplessly adjust a length of the second ball collecting unit.

The second ball collecting unit is composed of a plurality of stretching rods, which are sleeved together, and the length of the second ball collecting unit after stretching is fixed by a positioning assembly configured on the adjacent stretching rods.

The positioning assembly comprises at least one positioning hole and at least one positioning pin disposed on the adjacent stretching rods respectively.

The positioning pin is disposed on one of the adjacent stretching rods and inserted into the positioning hole of the other one of the adjacent stretching rods from inside or outside of the other one of the adjacent stretching rods.

The positioning assembly is a screw-type positioning element to fix the length of the second ball collecting unit after stretching.

In accordance with the preceding description, the ball collecting device with ball collecting module of the present invention may have one or more following advantages:

(1) In the ball collecting device with ball collecting module of the present invention, the ball collecting module is disposed on one side of the collecting component. In contrast to the ball collecting utensil without the ball collecting module in prior art, the ball collecting area can be expanded by the ball collecting module to improve the ball collecting efficiency regardless of the size of the collecting component.

(2) In the ball collecting device with ball collecting module of the present invention, the distance between the ball collecting module and the plane can be maintained constantly such that the ball will not be missed from the gap between the ball collecting module and the plane.

(3) In the ball collecting device with ball collecting module of the present invention, the ball can be allowed to pass through the hollow part by adjusting the diameter of the hollow part of the first cover, the second cover and/or the ring-shaped body, and the convenience of moving or getting the balls can be thereby improved.

(4) In the ball collecting device with ball collecting module of the present invention, the balls can be collected into the accommodation space of the collecting component easily and will be prohibited to get out of the collecting component by disposing the elastic elements around the peripheries of one side of the first cover, one side of the second cover and two sides of the ring-shaped body.

For better understanding and knowledge of the technical features and attainable technical effects of the present invention, it is to be understood that the preferred embodiments and the accompanying detailed description are given hereinafter.

DETAILED DESCRIPTION OF THE INVENTION

Figure 1:
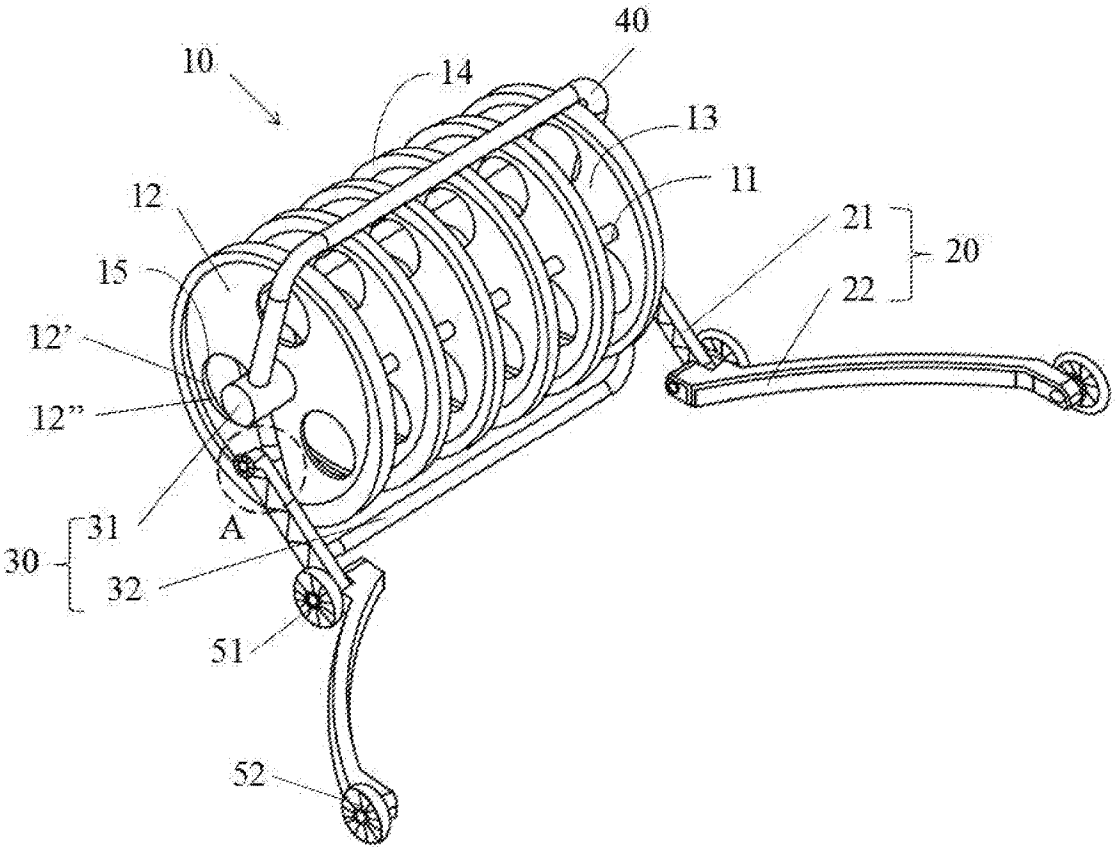
FIG. 1 is a schematic diagram showing the ball collecting device with ball collecting module according to a first embodiment of the present invention.

For purposes of understanding the technical features, contents, advantages and technical effects achieved thereby, various embodiments of the present invention will now be described in more detail with reference to the accompanying drawings. Drawings are used for illustrating and assisting in understanding the detailed description, not represent the real scale and precise configuration of the present invention. Therefore, the claims cope of the subject matter are not interpreted or limited by the scale and configuration of the accompanying drawings. Further, for purposes of explanation, in the drawings, similar symbols typically identify similar components, unless context dictates otherwise.

Figure 2:
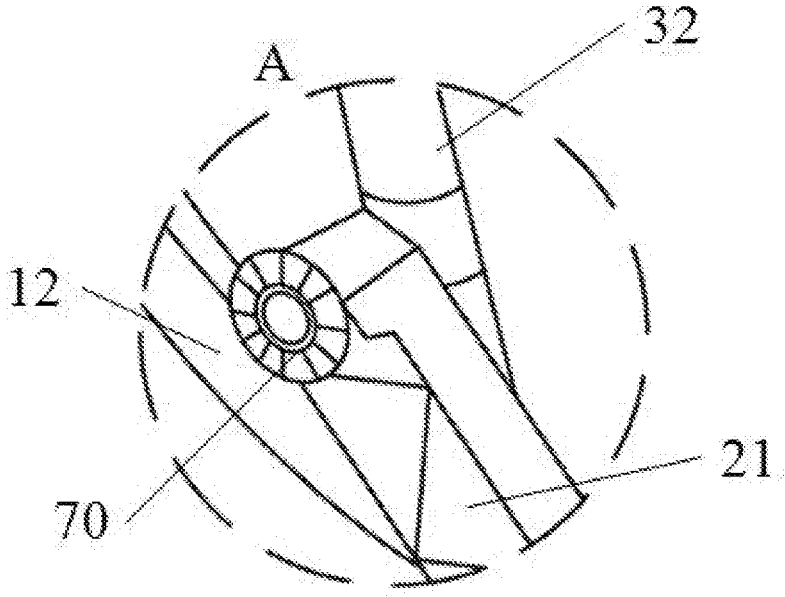
FIG. 2 is an enlarged schematic diagram showing region A shown in FIG. 1.
Figure 3:
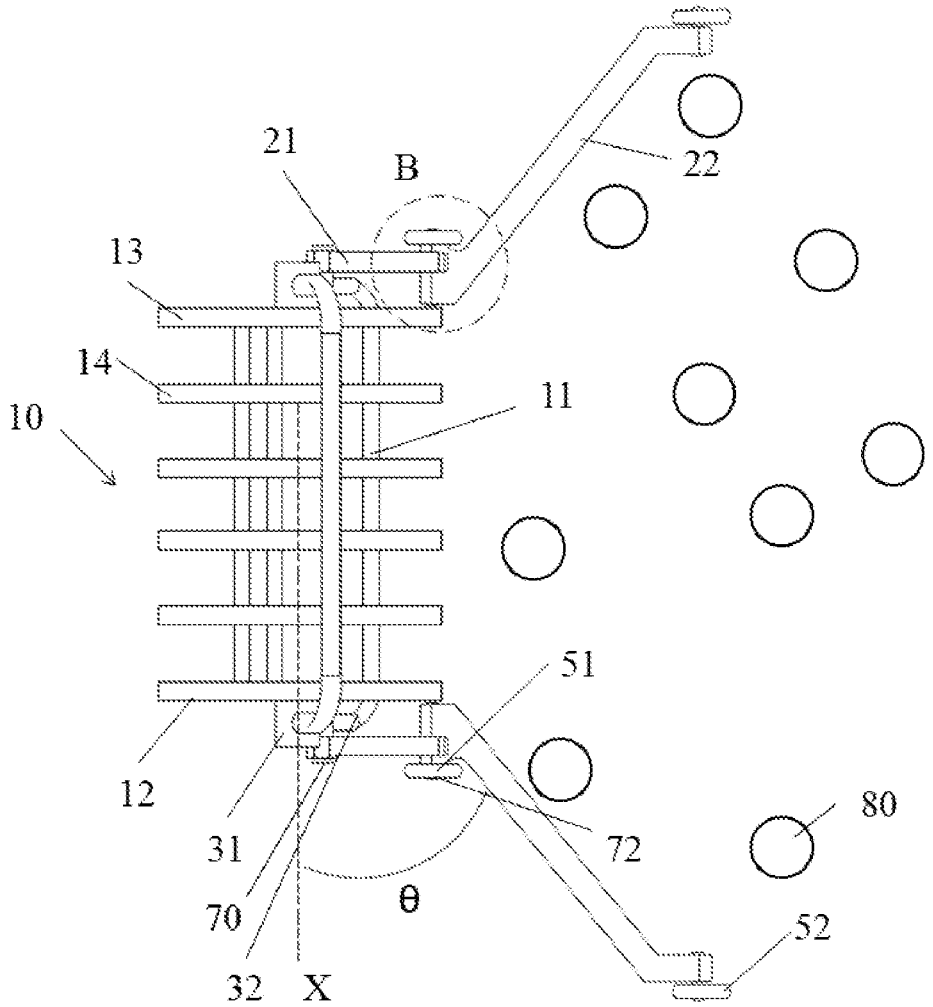
FIG. 3 is a top view schematic diagram showing the ball collecting device with ball collecting module according to the first embodiment of the present invention.
Figure 4:
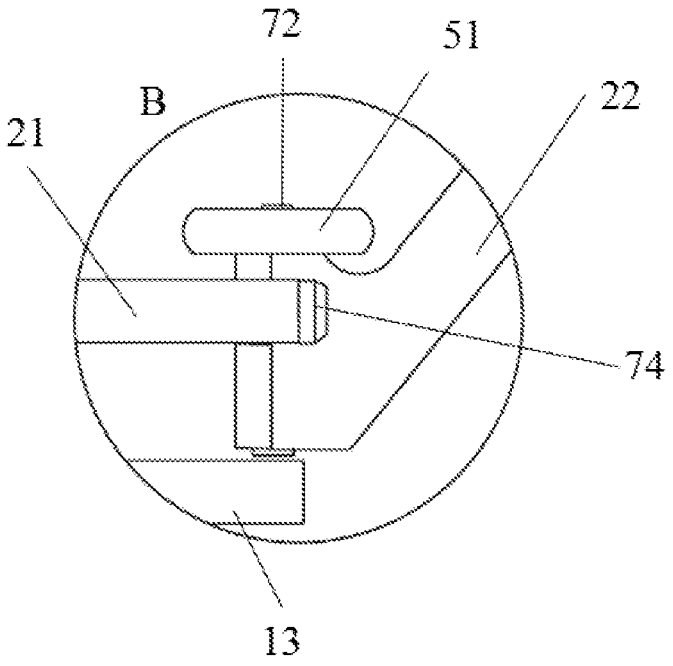
FIG. 4 is an enlarged schematic diagram showing region B shown in FIG. 3.

Referring to FIGS. 1 to 4, FIG. 1 is a schematic diagram showing the ball collecting device with ball collecting module according to a first embodiment of the present invention, FIG. 2 is an enlarged schematic diagram showing region A shown in FIG. 1, FIG. 3 is a top view schematic diagram showing the ball collecting device with ball collecting module according to the first embodiment of the present invention, and FIG. 4 is an enlarged schematic diagram showing region B shown in FIG. 3.

As shown in FIGS. 1 and 3, the ball collecting device with ball collecting module of the present invention comprises a collecting component 10 and at least one ball collecting module 20. The collecting component 10 at least has an accommodation space being used for accommodating at least one ball 80 such that the ball 80 can be collected into the accommodation space by rotating the collecting component 10. For example, in the present invention, the collecting component 10 can comprise at least one rod 11, a first cover 12, a second cover 13 and at least one ring-shaped body 14. The first cover 12 and the second cover 13 are disposed on two ends of the rod 11 respectively. The ring-shaped body(s) 14 is/are disposed on the rod 11 with a predetermined interval apart between the first cover 12 and the second cover 13 to form the accommodation space together. The structure of the aforementioned collecting component 10 is illustrated above for exemplification, but not limited thereto.

An angle θ is formed between the ball collecting module 20 and a rotation axle X of the collecting component 10 so as to expand the ball collecting area of the ball collecting device of the present invention. The angle θ is, for example, smaller than 90 degrees or equal to 90 degrees. Therefore, in contrast to the ball collecting utensil without the ball collecting module, the ball collecting area in the present invention can be expanded by the ball collecting module 20 to improve the ball collecting efficiency regardless of the size of the collecting component 10. Besides, the ball collecting module 20 is such as a detachable structure, the storage volume of the ball collecting device of the present invention can be therefore reduced. Additionally, the predetermined interval of the ring-shaped body 14 disposed on the rod 11 can be designed or configured to allow the balls with different diameters to pass therethrough such that the user can choose the ball collecting device with suitable predetermined interval according to the diameter of the ball 80 to be collected. In the present specification, the amount of the rod 11 is such as three (as shown in FIG. 3), but not limited thereto.

Figure 6:
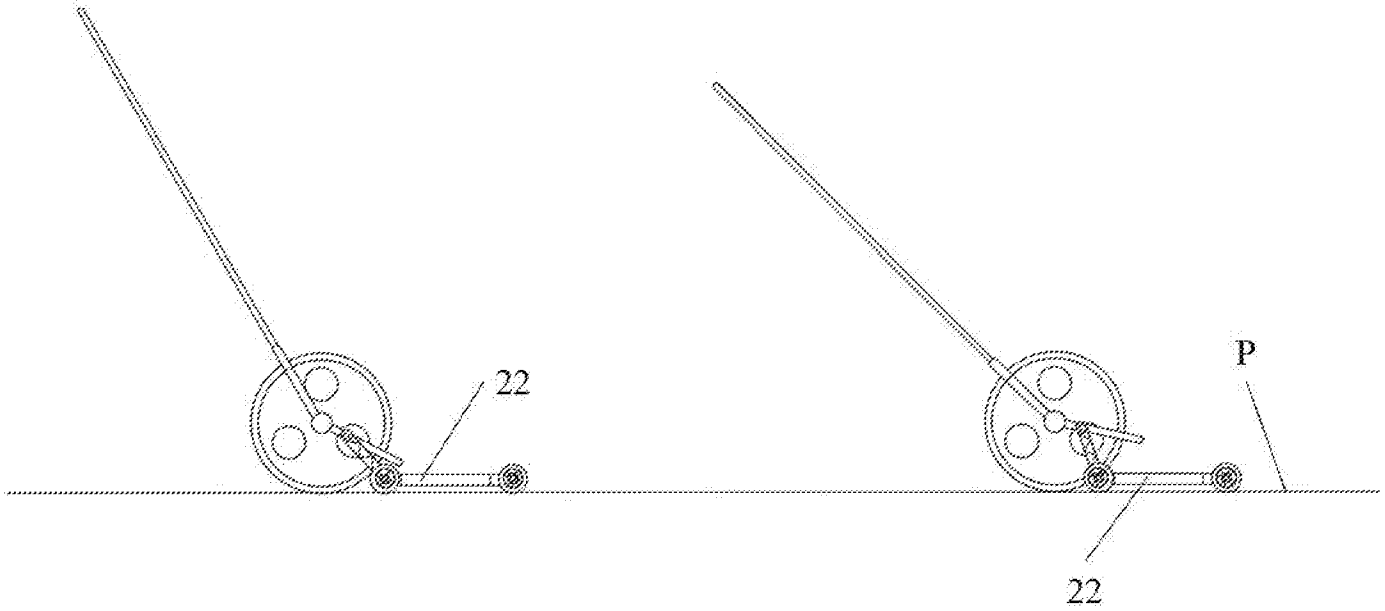
FIG. 6 is a schematic diagram showing the usage of the ball collecting device with ball collecting module according to the present invention.

In addition, when the ball 80 is collected by the ball collecting device of the present invention, a constant distance between the ball collecting module 20 and a plane P is maintained, which will be further illustrated in FIG. 6, and the constant distance is preferably smaller than a diameter of the ball 80. Namely, the bottom surface of the second ball collecting unit 22 is constantly floating in a distance from the plane P. Therefore, the ball 80 will not be missed from the gap between the ball collecting module 20 and the plane P. In the present specification, the plane P is such as the ground.

The first cover 12, the second cover 13 and/or the ring-shaped body 14 can further comprise(s) at least one hollow part 15 respectively, and a diameter of the hollow part 15 can be adjusted according to a diameter of the ball 80 for passing the ball 80 through the hollow part 15. Besides, first cover 12, the second cover 13 and the ring-shaped body 14 of the collecting component 10 can have a double-layer structure respectively. For example, the double-layer structure is such as two overlapped ring-shaped plates 12' and 12" having same amount and position of the hollow parts 15 (not shown in FIG. 1). The hollow parts 15 can be staggered together to be in a close state, or can be corresponded to each other to be in an open state by rotating the ring-shaped plate(s) 12' and/or 12". When the hollow parts 15 are in the open state and the size of the hollow parts 15 is preferably bigger than the diameter of the ball 80 in a manner that the user can take out the ball 80 from the hollow part 15. When the hollow parts 15 are in the close state and the size of the hollow parts 15 is preferably smaller than the diameter of the ball 80 in a manner that the user can't take out the ball 80 from the hollow part 15. Overall, the size of the hollow part 15 can be adjusted in a manner similar to a camera shutter or a mask by an adjustment device. And, the user can determine the size of the hollow part 15 according to the diameter of the balls 80 to be collected.

Figure 5:
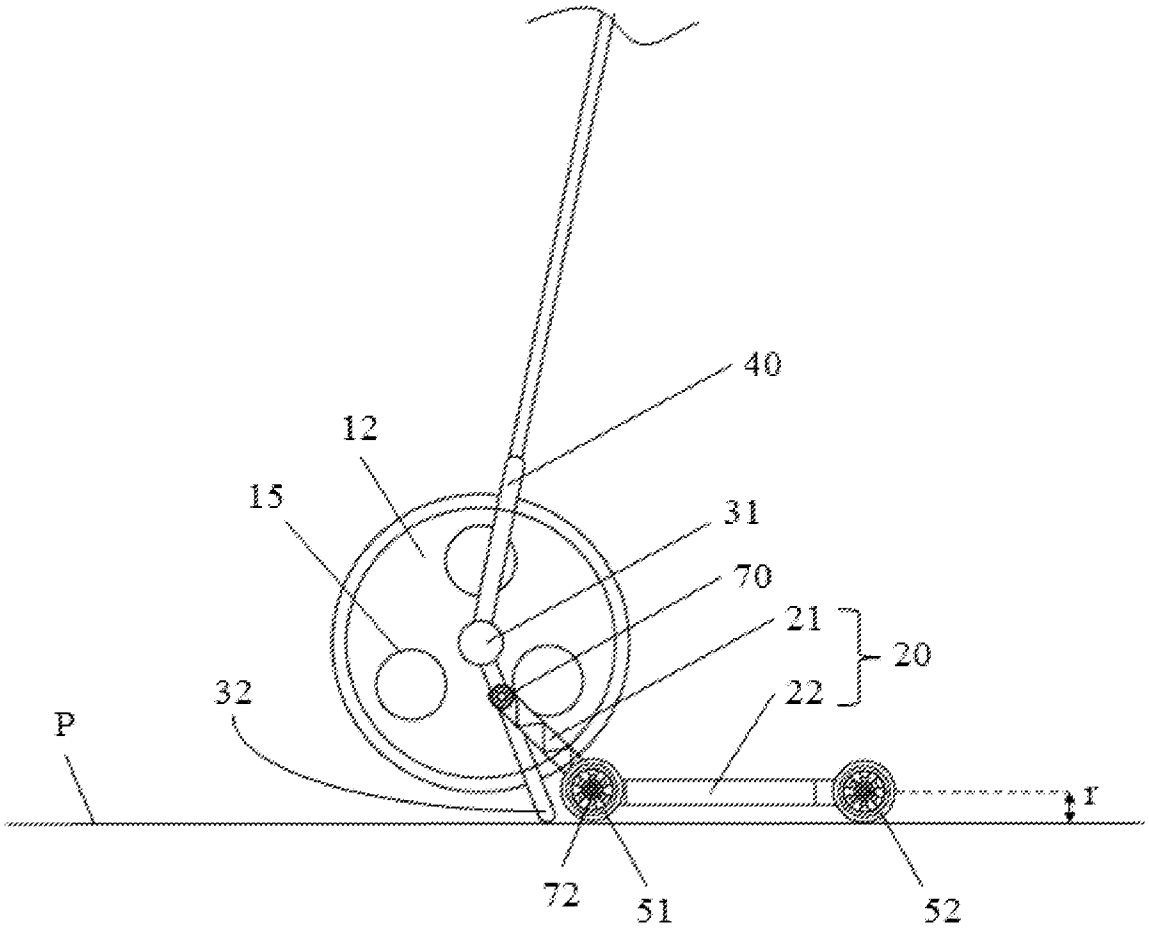
FIG. 5 is a side view schematic diagram showing the ball collecting device with ball collecting module according to the first embodiment of the present invention.

The ball collecting device with ball collecting module of the present invention can further comprise a support connection module 30, which is a support connection assembly. The support connection module 30 comprises at least one connection unit 31 and at least one support module 32, which is a support device. The connection unit 31 is disposed on one side of the collecting component 10, and one end of the support module 32 is connected to the connection unit 31, and another end of the support module 32 is configured to optionally lean against the plane P. Besides, the ball collecting device with ball collecting module of the present invention can further comprise a control module 40, which is a control device such as a rod, connected to the connection unit 31. The user can determine the collecting direction of the ball collecting device by holding and controlling the control module 40. And, the constant distance between the ball collecting module 20 and the plane P is automatically maintained constantly if an angle between the control module 40 and the plane P is changed. In the drawings of the present invention, the amount of the connection unit 31 is such as two, and these two connection units 31 are disposed on opposite sides of the collecting component 10 respectively and are located on the rotation axle X of the collecting component 10. The ends of the support module 32 and the control module 40 are connected to these two connection units 31 respectively such that the support module 32 can steadily contact with the plane P and the ball collecting device is in a standing state when the ball collecting device of the present invention is not utilized for collecting the ball 80 as shown in FIG. 5. The amounts of the connection unit 31 and support module 32 are illustrated for exemplification, but not limited thereto, and user can choose the suitable amounts of the connection unit 31 and support module 32.

The amount of the ball collecting module 20 is such as two, and the ball collecting modules 20 are pivoted on the opposite sides of the collecting component 10 respectively. Besides, the ball collecting module 20, which is a ball collecting assembly, at least comprises at least one first ball collecting unit 21 and at least one second ball collecting unit 22. The first ball collecting unit 21 is detachably pivoted on the support module 32, and the second ball collecting unit 22 is pivoted on the first ball collecting unit 21. And, as shown in FIG. 3, the first ball collecting unit 21 can be, for example, substantially perpendicular to the rotation axle X, and the angle θ can be, for example, formed between the second ball collecting unit 22 and the rotation axle X.

As shown in FIGS. 2 and 4, the first ball collecting unit 21 can be, for example, pivoted on the support module 32 by a first bearing 70, and the second ball collecting unit 22 can be, for example, pivoted on the first ball collecting unit 21 by a second bearing 72. By using the first bearing 70 and the second bearing 72, the frictional forces between the first ball collecting unit 21 and the support module 32, and the second ball collecting unit 22 and the first ball collecting unit 21 can be reduced so as to facilitate pivoting. Besides, the first ball collecting unit 21 can be, for example, detachably pivoted on the support module 32 via a C-shaped ring which has a hooking hole for detachable hooking the first ball collecting unit 21 to the support module 32. The aforementioned pivoting manners of the first ball collecting unit 21 and the second ball collecting unit 22 are illustrated for exemplification but not limited thereto.

The ball collecting device with ball collecting module of the present invention can further comprise a plurality of rollers 51, 52 disposed on two ends of the second ball collecting unit 22 respectively. As shown in FIG. 5, the aforementioned constant distance can be, for example, identical to or smaller than a radius r of the rollers 51, 52 when the ball is collected by the ball collecting device of the present invention. Alternatively, the constant distance can be a distance between a bottom surface of the second ball collecting unit 22 and the plane P, i.e. the second ball collecting unit 22 is suspended at a height from the plane P, wherein the height is preferably substantially smaller than or equal to a diameter of the ball. The constant distance between the second ball collecting unit 22 and the plane P can be, for example, automatically maintained by a spring 74 or gravity, namely, a weight of the second ball collecting unit 22, such that the rollers 51, 52 will always contact with the plane P. Therefore, the balls 80 will not be missed from the gap between the second ball collecting unit 22 and the plane P.

Figure 9:
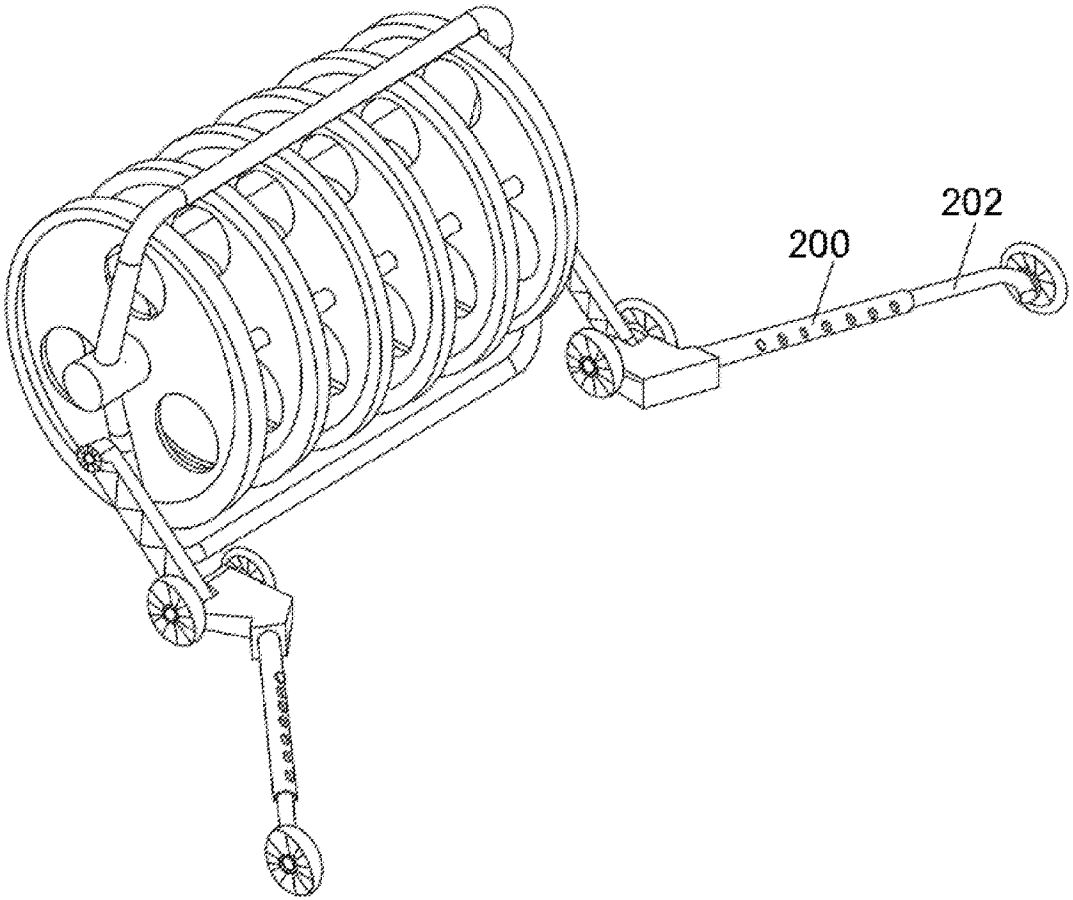
FIG. 9 is a schematic diagram showing the ball collecting device with ball collecting module of the present invention according to the third embodiment of the present invention, and the second ball collecting unit is in a shortened state.
Figure 10:
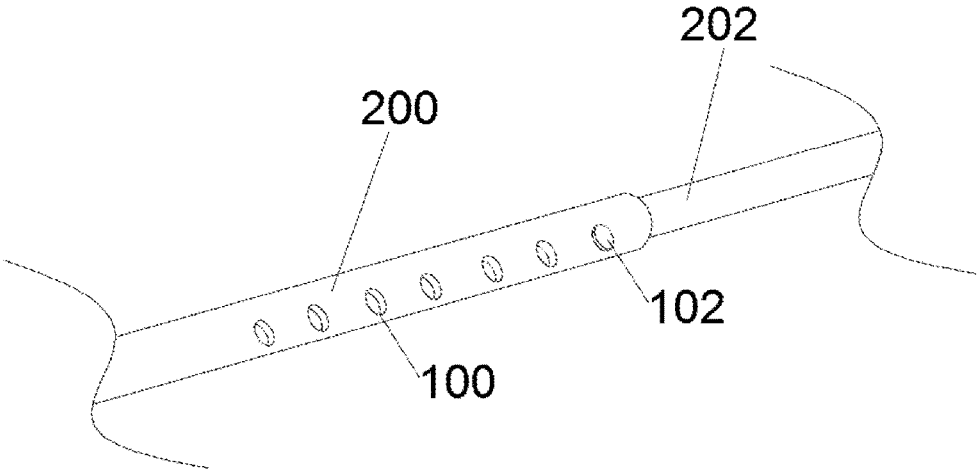
FIG. 10 is an enlarged schematic diagram showing a partial structure shown in FIG. 8.
Figure 11:
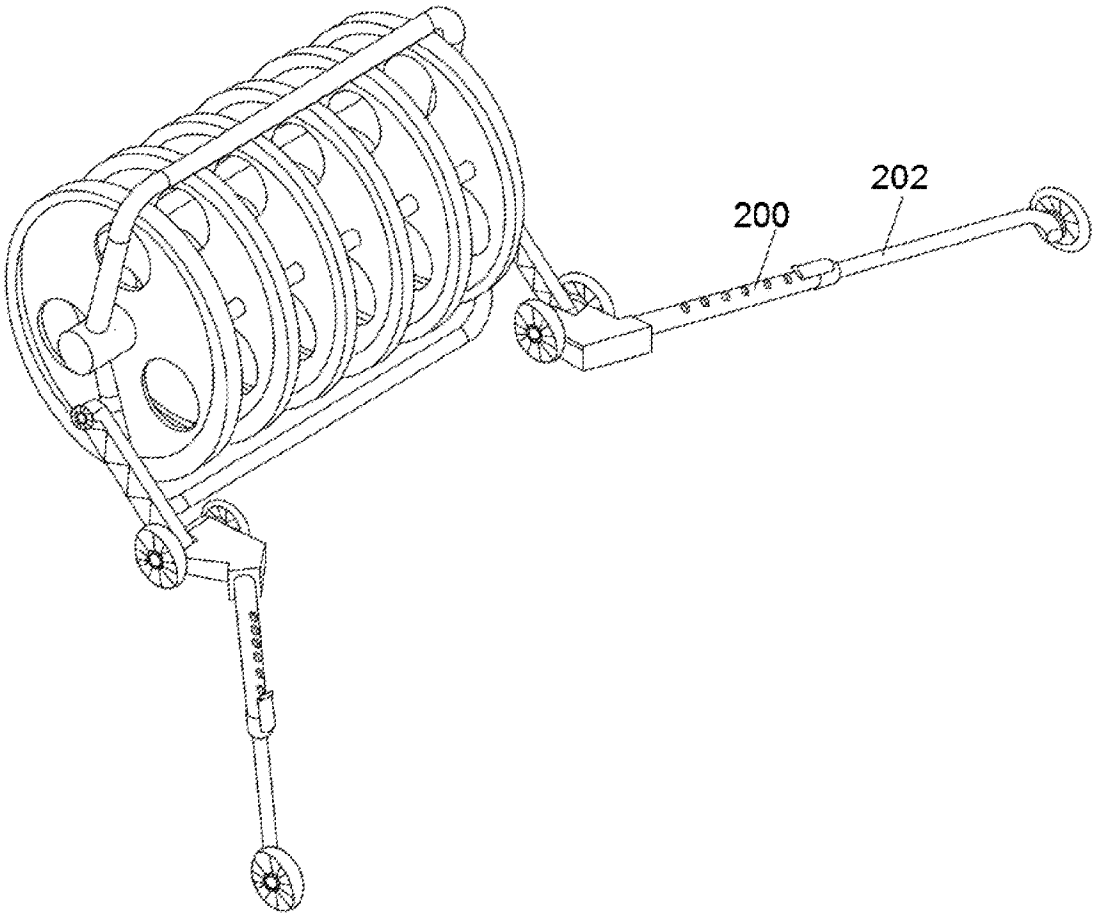
FIG. 11 is a schematic diagram showing the ball collecting device with ball collecting module according to a fourth embodiment of the present invention.
Figure 12:
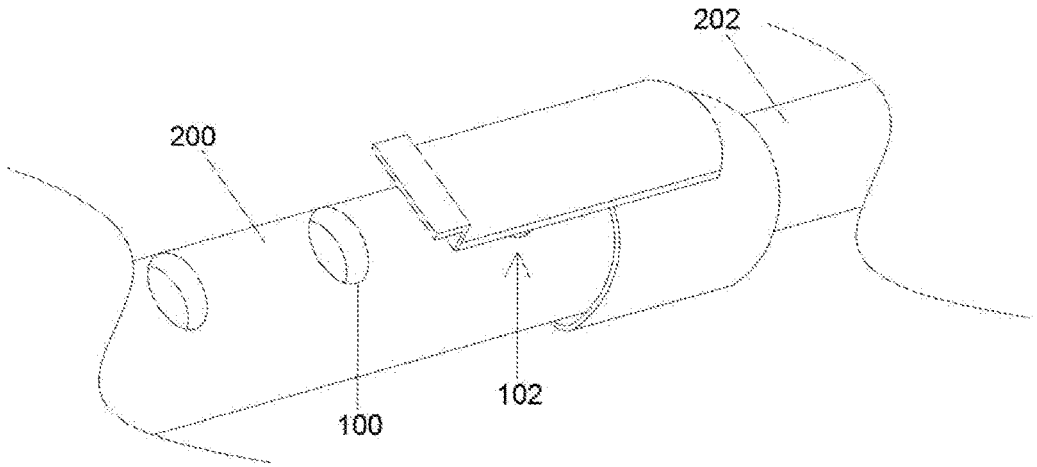
FIG. 12 is an enlarged schematic diagram showing a partial structure shown FIG. 11.

Referring to FIGS. 8 to 12, the second ball collecting unit 22 is composed of a plurality of stretching rods 200, 202, and these stretching rods can be, for example, sleeved together. The shape of the stretching rods can be cylindrical, square or other shape, and the overall shape can be curved, linear or other shape. The second ball collecting unit 22 is a stepped or stepless stretchable structure to steppedly or steplessly adjust a length of the second ball collecting unit 22. For example, the adjacent stretching rods preferably have a positioning assembly used for adjustably fixing the length of the second ball collecting unit 22 after stretching. The amount of the stretching rods is not limited to any value, and can be such as two or more stretching rods sleeved together. The sizes of the adjacent stretching rods are configured to comply with each other such that one stretching rod can be inserted into a hollow interior of another stretching rod. The positioning assembly may have any possible form as long as the second ball collecting unit 22 can be lengthened and shortened and can be positioned in a desired length. For example, the positioning assembly can comprise at least one positioning hole 100 and at least one positioning pin 102 disposed on the adjacent stretching rods 200, 202 respectively, and the amounts of the positioning hole 100 and the positioning pin 102 are not limited thereto. The positioning pin 102 is configured to insert into the positioning hole 100 from an inside (as shown in FIG. 10) or an outside (as shown in FIG. 12) of the stretching rod to achieve the purpose of steppedly positioning, and the length of the second ball collecting unit 22 can be thus fixed after stretching. For example, the positioning pin is disposed on one of the adjacent stretching rods and inserted into the positioning hole of the other one of the adjacent stretching rods from the inside or the outside of the other one of the adjacent stretching rods to achieve the purpose of positioning. And, the aforementioned positioning pin 102 is provided with restoring ability by a spring or a rubber or plastic structure. Therefore, the positioning pin 102 can be optionally separated from the positioning hole 100 by pressing the positioning pin 102. And, as shown in FIG. 9, after the second ball collecting unit 22 is stretched, the positioning pin 102 can be inserted into another positioning hole 100 by the foregoing restoring ability. The aforementioned rubber or plastic structure with restoring ability can be, for example, a curved structure such as a structure with an approximate Z-shaped cross-section as shown in FIG. 12. A part of the aforementioned curved structure can be held and pulled up by user to separate the positioning pin 102 from the positioning hole 100. After user releases the curved structure, the previous position is restored to the curved structure automatically such that the positioning pin 102 is inserted into the positioning hole 100. Besides, the positioning assembly can be a screw-type positioning element (not shown), which is a shrinkable ring, disposed on the stretching rod to fix the length of the second ball collecting unit 22 after stretching. And, the screw-type positioning element can be, for example, movably sleeved on one of the stretching rod and the purpose of steplessly positioning can be achieved by rotating the screw-type positioning element and locking the adjacent stretching rods.

Referring to FIG. 6, FIG. 6 is a schematic diagram showing the usage of the ball collecting device with ball collecting module according to the present invention. The constant distance between the ball collecting module 20 and the plane P can be automatically maintained when the ball is collected by the ball collecting device of the present invention. In other words, the constant distance between the second ball collecting unit 22 of the ball collecting module 20 and the plane P can be automatically maintained if an angle between the control module 40 and the plane P is changed during the ball collecting movements by the user because the second ball collecting unit 22 is pivoted on the first ball collecting unit 21 and the first ball collecting unit 21 is pivoted on the support module 32. Therefore, the constant distance between the second ball collecting unit 22 of ball collecting module 20 and the plane P can also be automatically maintained even if the users having different heights use the ball collecting device of the present invention to collect the balls. Consequently, the ball collecting device of the present invention is adapted for the users having different heights. And, as shown in FIG. 6, when the user standing at a fixed position pushes and pulls the ball collecting device of the present invention to collect the balls, the constant distance between the second ball collecting unit 22 and the plane P can also be automatically maintained. In other words, when the angle between the control module 40 and the plane P is changed, the constant distance between the ball collecting module 20 and the plane P can be automatically maintained. Therefore, the ball collecting device of the present invention is also adapted for the users having different ball collecting habits.

Figure 7:
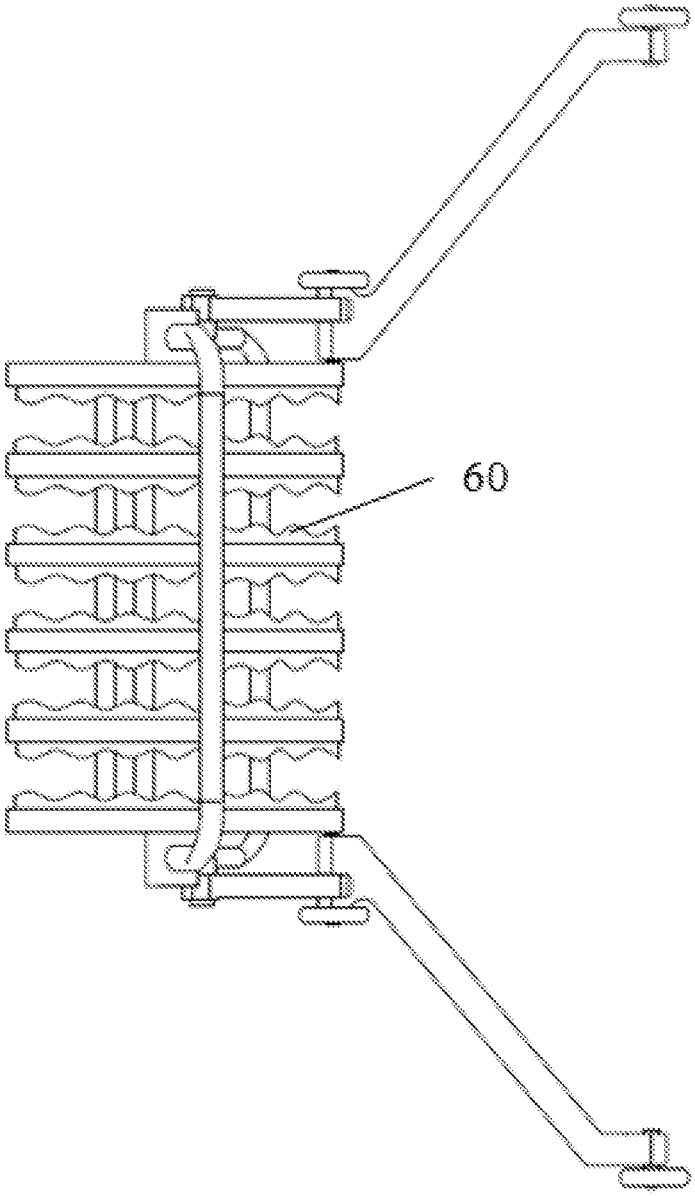
FIG. 7 is a side view schematic diagram showing the ball collecting device with ball collecting module according to a second embodiment of the present invention.
Figure 8:
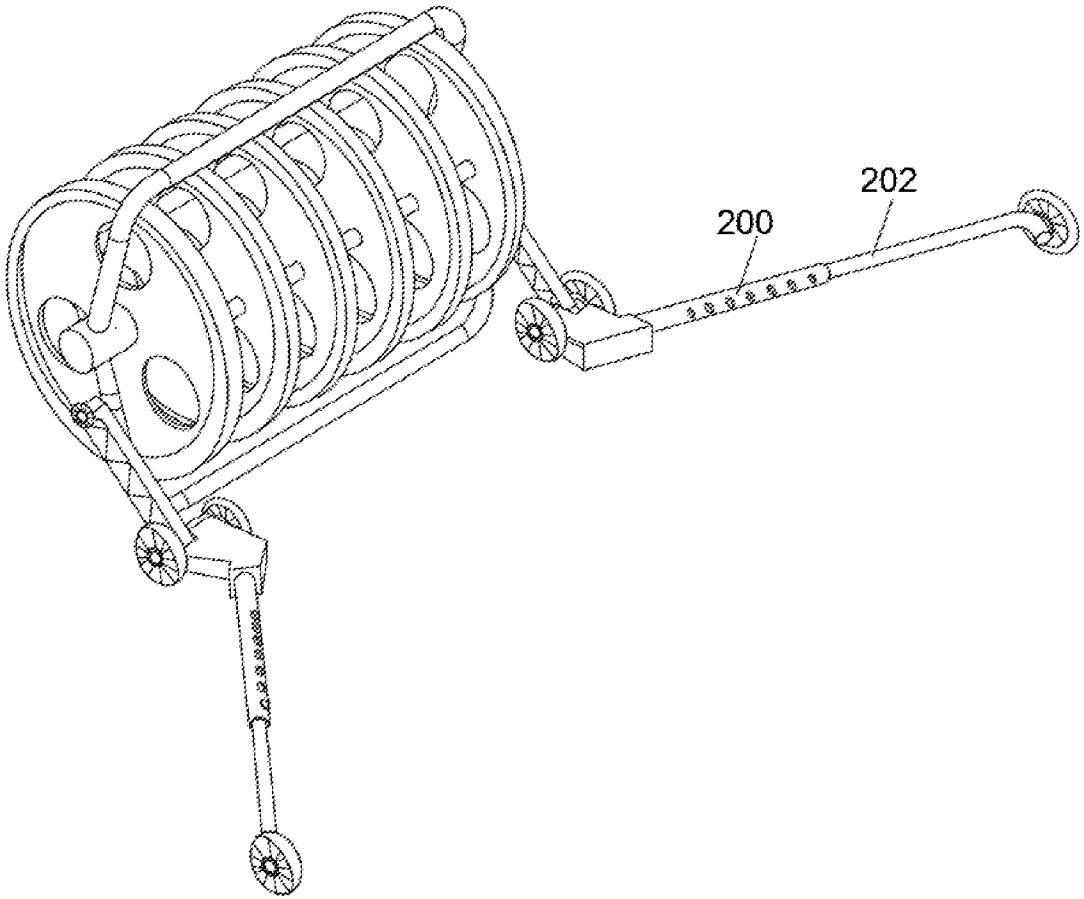
FIG. 8 is a schematic diagram showing the ball collecting device with ball collecting module according to a third embodiment of the present invention, and the second ball collecting unit is in an elongated state.

Referring to FIG. 7, FIG. 7 is a side view schematic diagram showing the ball collecting device with ball collecting module according to a second embodiment of the present invention. In the second embodiment of the ball collecting device of the present invention, a plurality of elastic elements 60 can be disposed around the peripheries of one side of the first cover 12, one side of the second cover 13 and two sides of the ring-shaped body 14 respectively, and these elastic elements 60 can be extended in a direction parallel to the rotation axle X. The material of the elastic element 60 can be, for example, flexible such as rubber, silicone or plastic. When the ball 80 to be collected contacts the collecting component 10, the elastic element 60 will deform because of the pressure generated by scrolling such that the ball 80 can enter the accommodation space between the first cover 12 and the ring-shaped body 14, the two ring-shaped bodies 14, or the second cover 13 and the ring-shaped body 14. Besides, the ball 80 can be prevented from getting out of the collecting component 10 since the gap between the two elastic elements 60 facing each other is preferably smaller than the diameter of the ball 80 and the gap between two adjacent ring-shaped bodies 14 are preferably larger than the diameter of the ball 80.

In summary, the ball collecting efficiency and convenience of colleting or getting the balls can be improved by using the ball collecting device with ball collecting module of the present invention, and the ball collecting device of the present invention can be adapted for the users having different heights and ball collecting habits.

While the invention has been described by way of example(s) and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A ball collecting device with ball collecting module, comprising:

a collecting component having an accommodation space being used for accommodating at least one ball such that the ball can be collected into the accommodation space by rotating the collecting component;

a support connection module comprising:

at least one connection unit disposed on one side of the collecting component; and at least one support module, wherein one end of the support module is connected to the connection unit, and another end of the support module is configured to optionally lean against a plane; and at least one ball collecting module pivoted on the collecting component such that an angle is formed between the ball collecting module and a rotation axle of the collecting component, and the angle is smaller than 90 degrees or equal to 90 degrees, wherein the ball collecting module comprises:

at least one first ball collecting unit detachably pivoted on the support module; and at least one second ball collecting unit pivoted on the first ball collecting unit, wherein the first ball collecting unit is substantially perpendicular to the rotation axle, and the angle is formed between the second ball collecting unit and the rotation axle, wherein a constant distance between the ball collecting module and the plane is maintained when the ball is collected by the ball collecting device.

2. The ball collecting device of claim 1, wherein the collecting component comprises:

at least one rod;

a first cover and a second cover disposed on two ends of the rod respectively; and at least one ring-shaped body disposed on the rod with a predetermined interval apart between the first cover and the second cover to form the accommodation space together.

3. The ball collecting device of claim 2, wherein each of the first cover, the second cover and the ring-shaped body has two overlapped ring-shaped plates having hollow parts to be staggered together in a close state or to be corresponded to each other in an open state by rotating the ring-shaped plate(s).

4. The ball collecting device of claim 2, wherein a plurality of elastic elements are disposed around the peripheries of one side of the first cover, one side of the second cover and two sides of the ring-shaped body respectively, and the elastic elements are extended in a direction parallel to the rotation axle.

5. The ball collecting device of claim 1, further comprising a control module connected to the connection unit.

6. The ball collecting device of claim 5, wherein the constant distance between the ball collecting module and the plane is maintained if an angle between the control module and the plane is changed.

7. The ball collecting device of claim 1, wherein the amount of the ball collecting module is two, and the ball collecting modules are pivoted on opposite sides of the collecting component respectively.

8. The ball collecting device of claim 1, wherein the first ball collecting unit is pivoted on the support module by a first bearing, and the second ball collecting unit is pivoted on the first ball collecting unit by a second bearing.

9. The ball collecting device of claim 1, further comprising a plurality of rollers disposed on two ends of the second ball collecting unit respectively.

10. The ball collecting device of claim 9, wherein the constant distance is identical to a radius of the rollers when the ball is collected by the ball collecting device.

11. The ball collecting device of claim 9, wherein the second ball collecting unit is at a height from the plane, and the height is smaller than or equal to a diameter of the ball.

12. The ball collecting device of claim 1, wherein the constant distance between the ball collecting module and the plane is automatically maintained when the ball is collected by the ball collecting device.

13. The ball collecting device of claim 1, wherein the constant distance between the second ball collecting unit and the plane is automatically maintained by a spring or a weight of the second ball collecting unit.

14. The ball collecting device of claim 1, wherein the second ball collecting unit is a stepped stretchable structure to steppedly adjust a length of the second ball collecting unit.

15. The ball collecting device of claim 14, wherein the second ball collecting unit is composed of a plurality of stretching rods sleeved together, and the length of the second ball collecting unit after stretching is fixed by a positioning assembly configured on the adjacent stretching rods.

16. The ball collecting device of claim 15, wherein the positioning assembly comprises at least one positioning hole and at least one positioning pin disposed on the adjacent stretching rods respectively.

17. The ball collecting device of claim 16, wherein the positioning pin is disposed on one of the adjacent stretching rods and inserted into the positioning hole of the other one of the adjacent stretching rods from an inside or an outside of the other one of the adjacent stretching rods.

18. The ball collecting device of claim 1, wherein the second ball collecting unit is a stepless stretchable structure to steplessly adjust a length of the second ball collecting unit.

* * * * *